US011699424B2

(12) United States Patent
Chen

(10) Patent No.: US 11,699,424 B2
(45) Date of Patent: Jul. 11, 2023

(54) NOISE SEPARATION HYBRID ACTIVE NOISE CANCELLATION SYSTEM

(71) Applicant: SteadyBeat Technology Corp., Hsinchu (TW)

(72) Inventor: Hao-Ming Chen, Hsinchu (TW)

(73) Assignee: STEADYBEAT TECHNOLOGY CORP., Hsinchu (TW)

( * ) Notice: Subject to any disclaimer, the term of this patent is extended or adjusted under 35 U.S.C. 154(b) by 0 days.

(21) Appl. No.: 17/677,387

(22) Filed: Feb. 22, 2022

(65) Prior Publication Data

US 2022/0277722 A1 Sep. 1, 2022

(30) Foreign Application Priority Data

Feb. 26, 2021 (TW) ..... 110107137

(51) Int. Cl.
*G10K 11/178* (2006.01)

(52) U.S. Cl.
CPC .. *G10K 11/17817* (2018.01); *G10K 11/17854* (2018.01)

(58) Field of Classification Search
CPC ..... G10K 11/17879; G10K 2210/3026; G10K 2210/3028; G10K 2210/3025; G10K 11/17853
See application file for complete search history.

(56) References Cited

U.S. PATENT DOCUMENTS

2015/0296296 A1* 10/2015 Lu ..... G10K 11/17881 381/71.11

* cited by examiner

*Primary Examiner* — Kile O Blair
(74) *Attorney, Agent, or Firm* — Muncy, Geissler, Olds & Lowe, P.C.

(57) ABSTRACT

The present invention provides an improved noise separation hybrid type ANC system, which includes a reference audio receiving device, an error audio receiving device, an audio output device, and an audio processing device. The audio processing device includes a feed-forward noise cancellation filter module, a feedback noise cancellation filter module, a mixer, a noise shaper, a first infinite impulse response filter, and a second infinite impulse response filter. When the noise bandwidth detector detects irregular noise, it adjusts the coefficient of the first infinite impulse response filter to set it as a low-pass filter; when regular noise is detected, the coefficient of the second infinite impulse response filter is adjusted to set it as a band-pass filter.

16 Claims, 7 Drawing Sheets

NOISE SEPARATION HYBRID ACTIVE NOISE CANCELLATION SYSTEM

BACKGROUND OF THE INVENTION

1. Technical Field

The present invention is related to a hybrid active noise cancellation system, and in particular to an improved noise separation hybrid active noise cancellation system.

2. Description of Related Technology

Presently, there are mainly two active types of active noise cancellation (ANC) technologies for earphones, and they are known as feed-forward noise cancellation and feedback noise cancellation. In addition, the combination of the two technologies of feed-forward noise cancellation and feedback noise cancellation is known as the hybrid noise cancellation. Different active noise cancellation technologies have their own limitation in terms of the depth and bandwidth of the noise cancellation, which is mainly determined based on the factors of the earphone acoustic structure, signal processing and signal delay in combination.

The working principle of the feed-forward noise cancellation system mainly outputs a signal having the same frequency response as the environmental noise but in opposite phase in order to achieve noise cancellation. For a microphone, it detects the noise and generates a signal in opposite phase through filter circuit to cancel the noise signal with the signal in opposite phase at the eardrum area, thereby reducing the noise level heard by people. The filter circuit here is mainly to compensate the difference between the noises at the eardrum and microphone. In addition, it also provides compensation effect on the feedback capability of the noise cancellation signal for the speaker.

The working principle of the feedback noise cancellation system is mainly to detect the noise at the eardrum area, followed by forming a basic feedback loop, in order to reduce the noise level at the area with a maximum extend. The entire loop is formed by the speaker and microphone feedback and the filter. It increases along with the filter gain (and its loop gain), and the noise residue becomes smaller, such that the noise cancellation performance can be increased. However, if the loop phase is close to ±180°, the "loop" signal" can be reversed, and the "+" of the denominator becomes "−". Under such condition, the loop gain regulating outcome is limited. This is due to that when it increases from 0.0 to 1.0, the result is an amplification. However, when it is equal to 1.0, the result becomes "dividing by zero", leading to unstable system, and howling sound often occurs with the increase of the frequency response level.

A hybrid active noise cancellation (Hybrid ANC) combines the feed-forward noise cancellation system and the feedback noise cancellation system in order to effectively improve the individual deficiencies of the two. The hybrid active noise cancellation system typically includes a pair of microphones, and the feed-forward noise cancellation system uses an external microphone to measure the environmental noise before entering the ear, in order to process such signal and to ensure precise reverse signal. In addition, the loudspeaker of the system is able to effectively cancel the environmental noise. The filter of the feedback noise cancellation system is used to collect the acoustic signal error adjacent to the microphone and feedback such error in order to perform error correction. However, in a traditional hybrid active noise cancellation structure, when an irregular high frequency noise is received, it is likely to affect the convergence of the feed-forward noise cancellation system; and when it receives a regular noise, it is likely to affect the convergence of the feedback noise cancellation system. Consequently, the overall performance of the hybrid active noise cancellation system is reduced.

BRIEF SUMMARY OF THE INVENTION

An aspect of the present invention provides an improved noise separation hybrid active noise cancellation system, comprising: a reference audio receiving device, receiving a reference audio source and outputting a reference audio source signal based on the reference audio source; an error audio receiving device, receiving an error audio source and outputting an error audio source signal based on the error audio source; an audio output device, outputting an audio signal; and an audio processing device, connected to the reference audio receiving device, the error audio receiving device and the audio output device; the audio processing device comprising a feed-forward noise cancellation filter module, a feedback noise cancellation filter module, a mixer, a noise shaper, a first infinite impulse response filter and a second infinite impulse response filter; the feed-forward noise cancellation filter module used for performing feed-forward noise cancellation on the reference audio signal received from the reference audio receiving device in order to obtain a feed-forward noise cancellation signal; the feedback noise cancellation filter module used for performing feedback noise cancellation on the error audio source signal received from the error audio receiving device in order to obtain a feedback noise cancellation signal; and transmitting the feed-forward noise cancellation signal and the feedback noise cancellation signal to the mixer to perform wave mixing, and outputting a noise cancellation signal after mixing to the audio output device; and wherein the noise shaper detects a noise bandwidth distribution of the error audio source signal, such that when the noise shaper detects an irregular noise, a coefficient of the first infinite impulse response filter is adjusted to set the first infinite impulse response filter as a low-pass filter, and the first infinite impulse response filter with the corrected coefficient converts the error audio source signal into a low frequency audio source correction signal for outputting to a feed-forward least mean square filter of the feed-forward noise cancellation filter module; when the noise shaper detects a regular noise, a coefficient of the second infinite impulse response filter is adjusted to set the second infinite impulse response filter as a band-pass filter, and the second infinite impulse response filter with the corrected coefficient converts the error audio source signal into a designated bandwidth audio source correction signal for outputting to a feedback least mean square filter of the feedback noise cancellation filter module.

Therefore, the present invention is able to prevent the impact of an irregular noise on the convergence of the feed-forward noise reduction filter module upon receipt of the irregular noise and is also able to prevent the impact of a regular noise on the convergence of the feedback noise reduction filter module upon the receipt of the regular noise, thereby effectively increasing the noise cancellation effect of the hybrid active noise cancellation system of the present invention.

DETAILED DESCRIPTION OF THE INVENTION

The technical contents of this disclosure will become apparent with the detailed description of embodiments accompanied with the illustration of related drawings as follows.

The present invention can be implemented in noise cancellation device or noise cancellation controller in a personal listening system including, such as, wired headphones, smart phones, wireless earphones or other head wearable audio devices; or in other embodiments, the present invention can also be implemented in a soundproof chamber, aircraft, spacecraft, or other similar devices or equipment that is equipped with limited soundproof system, and the present invention is not limited to specific type of devices.

The terms of "device", "unit", "module" and its corresponding execution functions described in the present invention can be collaboratively executed by one single chip or a combination of plurality of chips. The quantity of the configuration of such chips is not limited by the scope of the present invention. In addition, the aforementioned chip can be, but not limited to, Processor, Central Processing Unit (CPU), Microprocessor, Digital Signal Processor (DSP), Application Specific Integrated Circuits (ASIC), Programmable Logic Device (PLD), etc., and a combination thereof, and the present invention is not limited to any specific of type of chip. In another embodiment, the terms of "device", "unit", "module" or its combination can be a built-in chip of a device (such as mobile device, wearable device), or can be formed by the chip integrated or separately from the device main body. It can be understood that such changes are not limited by the scope of the present invention.

Figure 1:
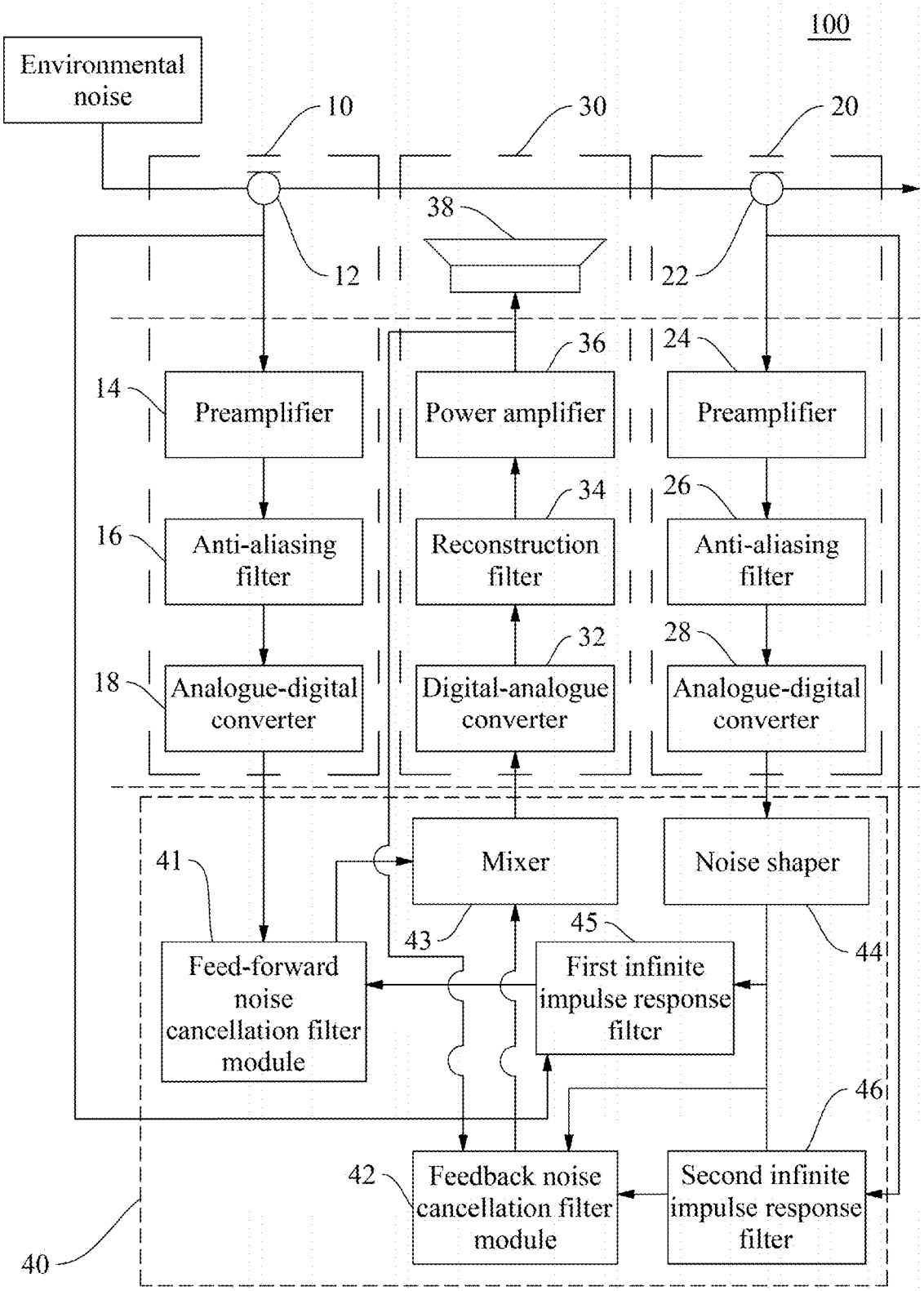
FIG. 1 shows a block diagram (1) of the improved noise separation hybrid active noise cancellation system of the present invention.
Figure 2:
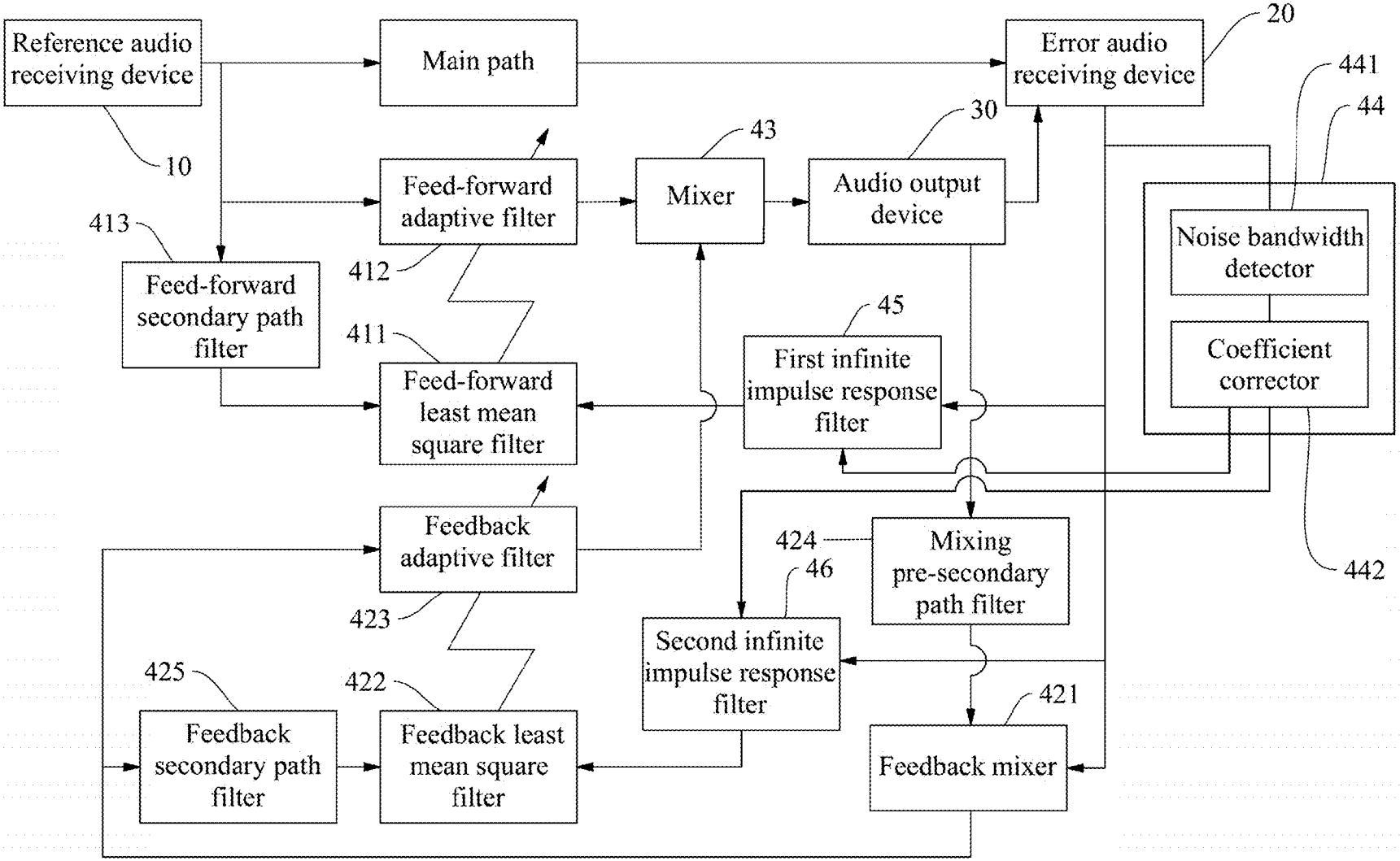
FIG. 2 shows a block diagram (2) of the improved noise separation hybrid active noise cancellation system of the present invention.

The following provides detailed description on one of the embodiments of the present invention. Please refer to FIG. 1 and FIG. 2, showing block diagram (1) and block diagram (2) of the improved noise separation hybrid active noise cancellation system of the present invention respectively.

An improved noise separation hybrid active noise cancellation system 100 disclosed according to this embodiment mainly comprises a reference audio receiving device 10, an error audio receiving device 20, an audio output device 30 and an audio processing device 40.

The reference audio receiving device 10 is mainly used for receiving a reference audio source and outputting a reference audio source signal based on the reference audio source. The reference audio source can be, such as, an environmental noise. In one embodiment, the reference audio receiving device 10 may comprise a microphone, a pickup unit and an audio processing chip in conjunction with such arrangement, or similar device capable of receiving sound and further converting into analogue or digital audio signal. In one embodiment, the reference audio receiving device 10 comprises a reference microphone 12, a preamplifier 14 connected to a rear end of the reference microphone 12, an anti-aliasing filter 16 connected to a rear end of the preamplifier 14 and an analogue-digital converter 18 connected to a rear end of the anti-aliasing filter 16. The reference sound source signal outputted by the analogue-digital converter 18 is outputted to the audio processing device 40.

The error audio receiving device 20 is mainly used for receiving an error audio source and outputting an error audio source signal based on the error audio source. The error audio receiving device 20 is arranged within the scope of the noise cancellation area and is used for detecting the sound in the scope of the noise cancellation area. Based on the arrangement location of the error audio receiving device 20, the error audio source received is equivalent to the difference between the reference audio source and the sound outputted by the loudspeaker. In one embodiment, the error audio receiving device 20 may comprise a microphone, a pickup unit and an audio processing chip in conjunction with such arrangement, or similar device capable of receiving sound and further converting into analogue or digital audio signal. In one embodiment, the error audio receiving device 20 comprises an error microphone 22, a preamplifier 24 connected to a rear end of the error microphone 22, an anti-aliasing filter 26 connected to a rear end of the preamplifier 24, and an analogue-digital converter 28 connected to a rear end of the anti-aliasing filter 26. The error audio source signal outputted by the analogue-digital converter 28 is outputted to the audio processing device 40.

The audio output device 30 is mainly used for outputting an audio signal for reversely offsetting the environmental noise. In one embodiment, the audio output device 30 may comprise a loudspeaker, a speaker and an audio processing chip in conjunction with such arrangement, or similar device used for outputting sound. In one embodiment, the audio output device 30 sequentially comprises a loudspeaker 38, a power amplifier 36 connected to a front end of the loudspeaker 38, a reconstruction filter 34 connected to a front end of the power amplifier 36, and a digital-analogue converter 32 connected to a front end of the reconstruction filter 34. In addition, the digital-analogue converter 32 is connected to the audio processing device 40 in order to convert a digital signal outputted by the audio processing device 40 into an analogue signal that can be played by the loudspeaker 38.

The audio processing device 40 is connected to the reference audio receiving device 10, the error audio receiving device 20 and the audio output device 30, and it is used for processing the reference audio signal and the error audio source signal received by the reference audio receiving device 10 and the error audio receiving device 20, as well as outputting a signal to the audio output device 30, in order to output an audio signal via the audio output device 30. The audio processing device 40 comprises a feed-forward noise cancellation filter module 41, a feedback noise cancellation filter module 42, a mixer 43, a noise shaper 44, a first infinite impulse response filter 45 and a second infinite impulse response filter 46.

The feed-forward noise cancellation filter module 41 is used for performing feed-forward noise cancellation on the reference audio signal received by the reference audio receiving device 10 in order to obtain a feed-forward noise cancellation signal. To be more specific, the feed-forward noise cancellation filter module 41 performs adaptive computation on the reference audio source signal received and uses the signal generated to offset the low frequency noise in the environmental noise, in order to achieve the effect of low frequency noise cancellation. The signal outputted by the feed-forward noise cancellation filter module 41 used for offsetting the low frequency noise in the environmental noise is defined as a low frequency noise cancellation signal. As shown in FIG. 2, the feed-forward noise cancellation filter module 41 comprises a feed-forward least mean square filter (LMS filter) 411 and a feed-forward adaptive filter 412. In addition, the feed-forward least mean square filter 411 updates the weight coefficient of the feed-forward adaptive filter 412 based on the reference audio source signal received and the low frequency audio source correction signal outputted by the first infinite impulse response filter 45. The feed-forward adaptive filter 412 performs noise cancellation on the reference audio signal based on the updated weight coefficient in order to output the feed-forward noise cancellation signal to the mixer 43.

In this embodiment, a feed-forward secondary path filter 413 is arranged between the reference audio receiving device 10 and the feed-forward least mean square filter 411, in order to perform wave filtering on the reference audio source signal in advance. The feed-forward secondary path filter 413 is used for estimating the transfer function on the actual path, allowing the feed-forward least mean square filter 411 to adjust the weight coefficient of the feed-forward adaptive filter 412 in order to further generate a low frequency noise cancellation signal having an amplitude the same as the low frequency noise in the environmental noise but in different phase for transmitting to the mixer 43.

The feedback noise cancellation filter module 42 performs feedback noise cancellation on the error audio source signal received from the error audio receiving device 20 in order to obtain a feedback noise cancellation signal. To be more specific, the feedback noise cancellation filter module 42 performs adaptive computation on the error audio source signal received and uses the signal generated to offset the high frequency noise in the environmental noise, in order to achieve the effect of noise cancellation. The signal outputted by the feedback noise cancellation filter module 42 used for offsetting the high frequency noise in the environmental noise is defined as a high frequency noise cancellation signal. As shown in FIG. 2, the feedback noise cancellation filter module 42 comprises a feedback mixer 421, a feedback least mean square filter (LMS filter) 422, and a feedback adaptive filter 423. The feedback mixer 421 is used for mixing the audio signal with the error audio source signal, followed by outputting a mixed signal. The audio signal received by the feedback mixer 421 is obtained via the feedback signal inputted into the loudspeaker 38. The feedback least mean square filter 422 updates the weight coefficient of the feedback adaptive filter 423 based on the mixed signal received and the designated bandwidth audio source correction signal outputted by the second infinite impulse response filter 46.

In one embodiment, a mixing pre-secondary path filter 424 is arranged on the path of the signal inputted to the loudspeaker 38 feed back to the feedback mixer 421, in order to perform wave filtering on the feedback signal inputted into the loudspeaker 38 in advance. In one embodiment, the feedback secondary path filter 425 is arranged between the feedback mixer 421 and the feedback least mean square filter 422, in order to perform wave filtering on the feedback mixing signal in advance. The mixing pre-secondary path filter 424, the feedback secondary path filter 425 are used to estimate the transfer function on the actual path, in order to allow the feedback least mean square filter 422 to update the weight coefficient of the feedback adaptive filter 423 based on the feedback mixing signal and the designated bandwidth audio source correction signal received. The feedback adaptive filter 423 performs noise cancellation on the feedback mixing signal based on the updated weight coefficient in order to output the feedback noise cancellation signal to the mixer 43.

The mixer 43 is used for mixing the feed-forward noise cancellation signal and the feedback noise cancellation signal, and for outputting a noise cancellation signal. In addition, it is able to output the noise cancellation signal mixed by the feed-forward noise cancellation signal and the feedback noise cancellation signal to the audio output device 30.

The noise shaper 44 comprises a noise bandwidth detector 441 and a coefficient corrector 442, and a frequency detector (not shown in the drawings) is arranged between the coefficient corrector 442 and the reference microphone 12. The noise bandwidth detector 441 is used for detecting the noise bandwidth distribution of the error audio source signal.

The first infinite impulse response filter 45 comprises a biquadratic filters of levels 1 to N. The biquadratic filters of levels 1 to N adopt a series configuration method, allowing the input of one biquadratic filter to be connected to the output of another biquadratic filter of previous level (such as the input of the biquadratic filter of level N is connected to the input of the biquadratic filter of level N−1). The number of levels of the biquadratic filters can be configured depending upon the actual needs, and the present invention is not limited to any specific number of levels.

Figure 3:
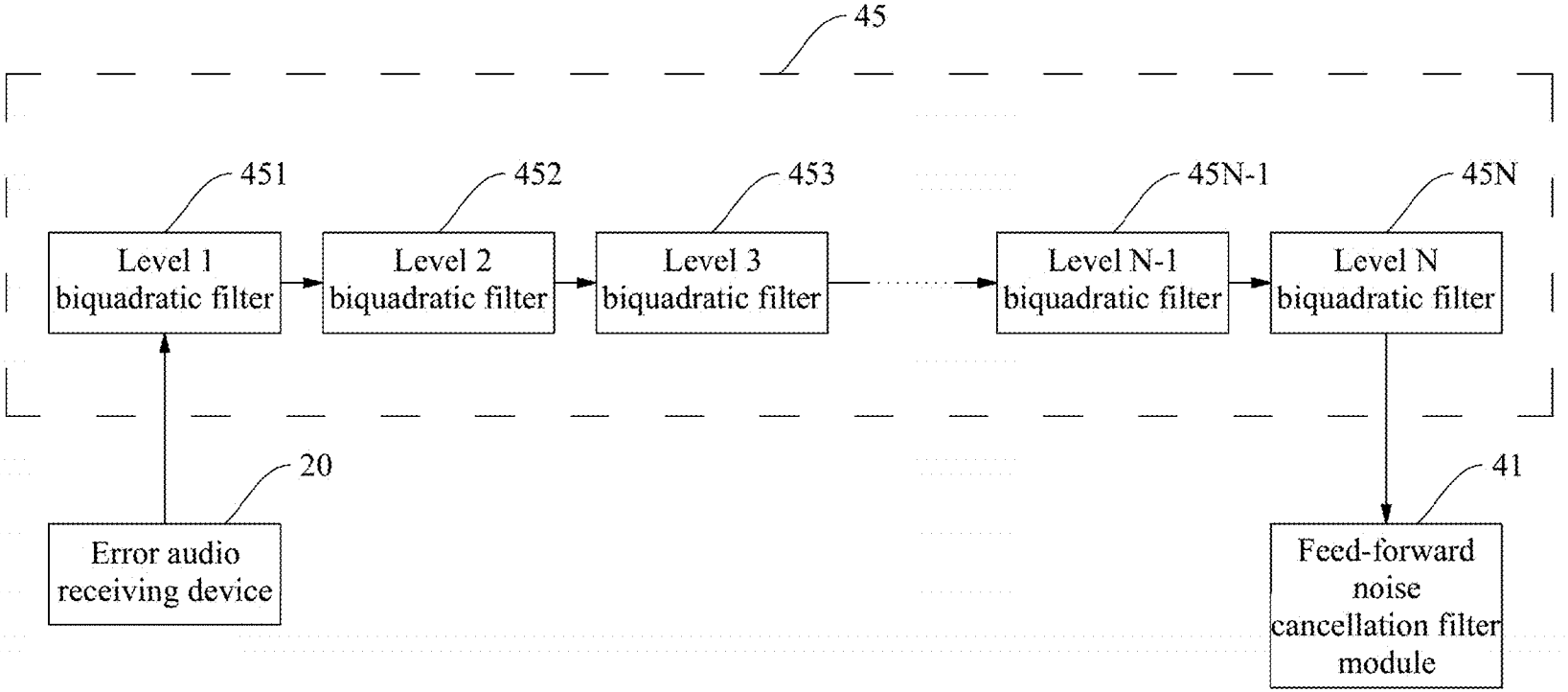
FIG. 3 shows a block diagram of the level configuration of the biquadratic filters of levels 1 to N of the first infinite impulse response filter.

In one embodiment, the level configuration of the biquadratic filters of levels 1 to N of the first infinite impulse response filter 45 is as follows, and please refer to FIG. 3 and FIG. 4 together: The output of the level 1 biquadratic filter 451 is connected to another input of the level 2 biquadratic filter 452; the output end of the level 2 biquadratic filter 452 is connected to another input end of the level 3 biquadratic filter 453, and so on; finally, the output end of the level N−1 biquadratic filter 45N−1 is connected to another input end of the level N biquadratic filter 45N.

Figure 4:
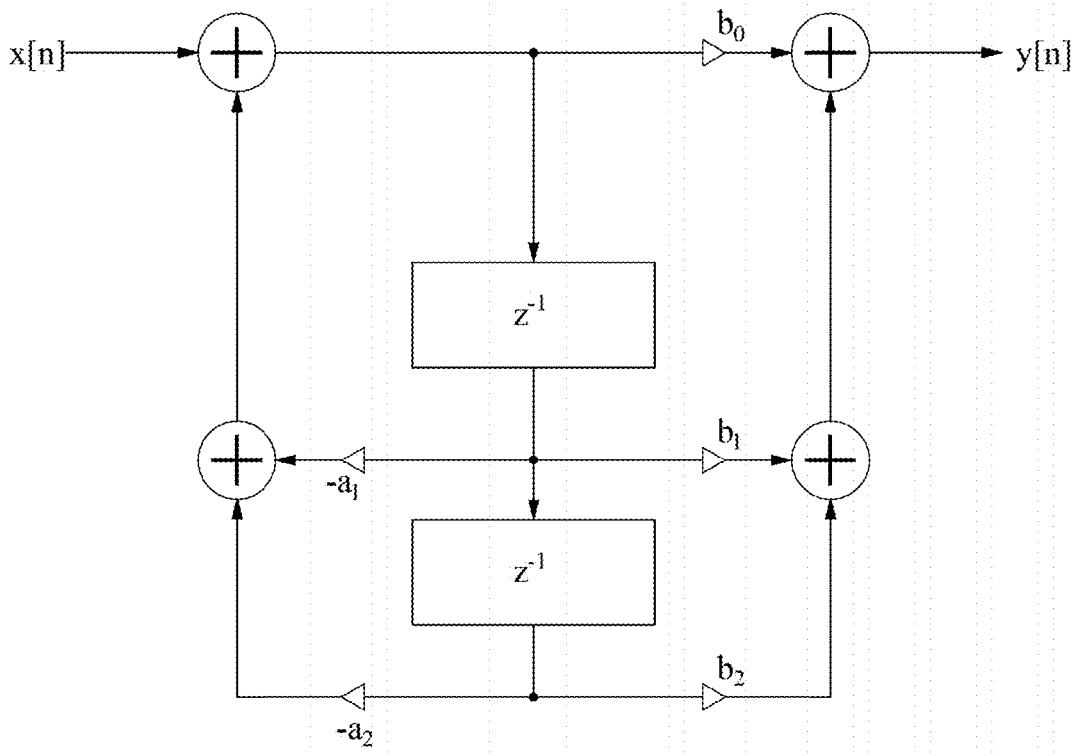
FIG. 4 shows a block diagram of the biquadratic filter of single level of the first infinite impulse response filter.

As shown in FIG. 4, the biquadratic filters of each level of the first infinite impulse response filter 45 perform wave filtering on the error audio source signal based on the following equation:

$$y[n]=b_0\times x[n]+b_1\times x[n-1]+b_2\times x[n-2]-a_1\times y[n-1]-a_2\times y[n-2];$$

wherein x[n], x[n−1], x[n−2] refer to signals inputted to the biquadratic filters at level n, level n−1, and level n−2, y[n] y[n−1], y[n−2] refer to signals outputted by the biquadratic filters at level n, level n−1 and level n−2, $b_0$, $b_1$, $b_2$, $a_1$, $a_2$ refer to coefficients of the biquadratic filters.

The second infinite impulse response filter 46 comprises a biquadratic filters of levels 1 to N. The biquadratic filters of levels 1 to N adopts a series configuration method, allowing the input of one biquadratic filter to be connected to the output of another biquadratic filter of previous level (such as the input of the biquadratic filter of level N is connected to the input of the biquadratic filter of level N−1). The number of levels of the biquadratic filter can be configured depending upon the actual needs, and the present invention is not limited to any specific number of levels.

Figure 5:
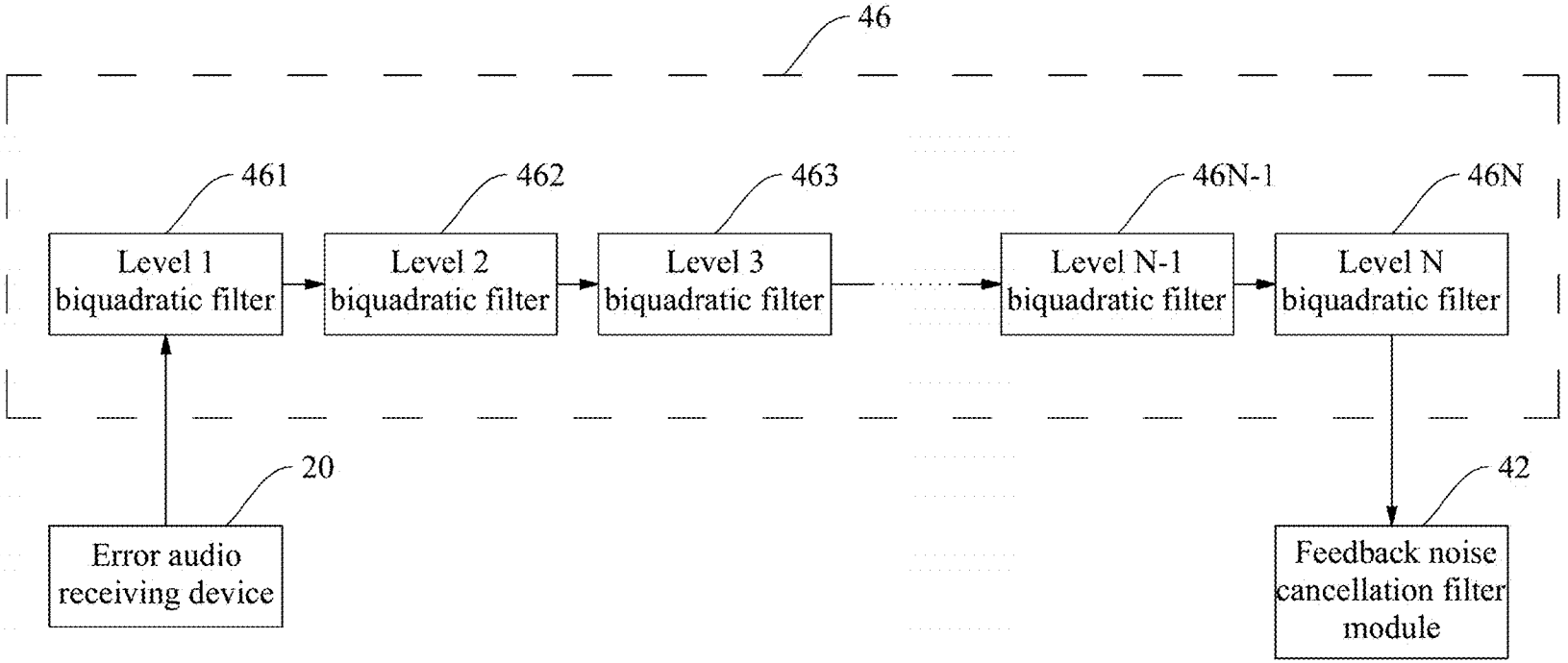
FIG. 5 shows a block diagram of the level configuration of the biquadratic filters of levels 1 to N of the second infinite impulse response filter.

The level configuration of the biquadratic filters of levels 1 to N of the second infinite impulse response filter 46 is as follows, and please refer to FIG. 5 and FIG. 6 together: The output end of the level 1 biquadratic filter 461 is connected to another input end of the level 2 biquadratic filter 462; the output end of the level 2 biquadratic filter 462 is connected to another input end of the level 3 biquadratic filter 463, and so on; finally, the output end of the level N−1 biquadratic filter 46N−1 is connected to another input end of the level N biquadratic filter 46N.

Figure 6:
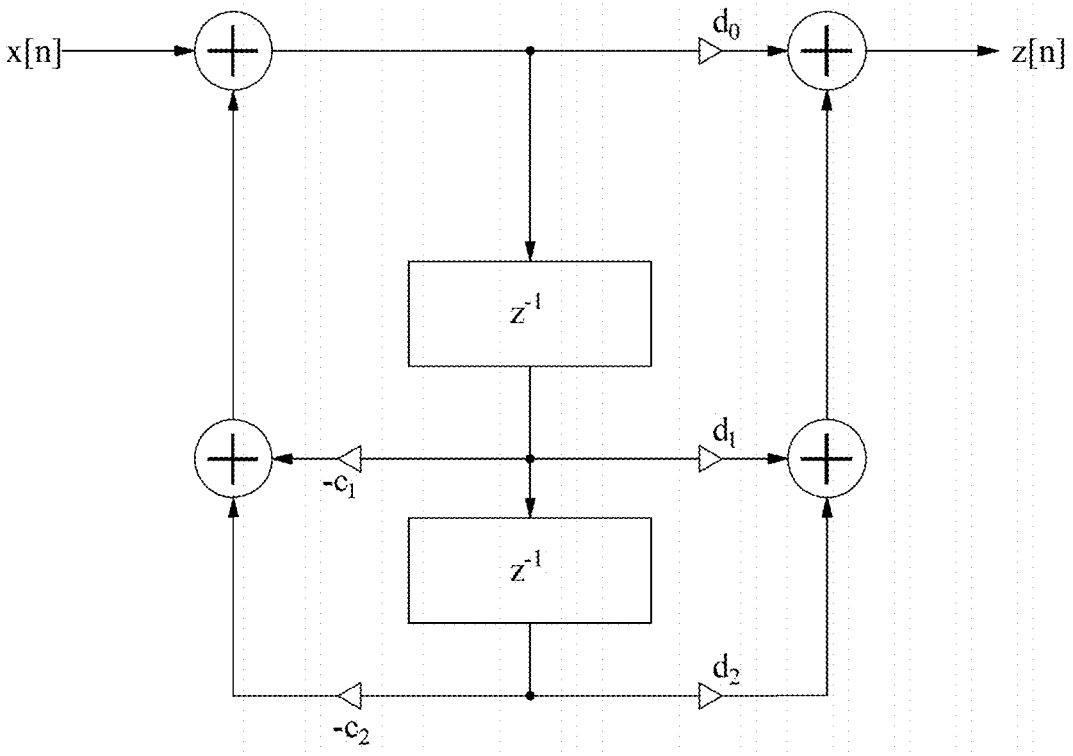
FIG. 6 shows a block diagram of the biquadratic filter of single level of the second infinite impulse response filter.

As shown in FIG. 6, the biquadratic filters of each level of the second infinite impulse response filter 46 perform wave filtering on the error audio source signal based on the following equation:

$$z[n]=d_0\times x[n]+d_1\times x[n-1]+d_2\times x[n-2]-c_1\times z[n-1]-c_2\times z[n-2];$$

wherein x[n], x[n−1], x[n−2] refer to signals inputted to the biquadratic filters at level n, level n−1, and level n−2, z[n], z[n−1], z[n−2] refer to signals outputted by the biquadratic filters at level n, level n−1 and level n−2; $d_0$, $d_1$, $d_2$, $c_1$, $c_2$ refer to coefficients of the biquadratic filters.

When the noise shaper 44 detects an irregular noise, it adjusts the coefficient of the first infinite impulse response filter 45 in order to set the first infinite impulse response filter 45 as a low-pass filter, and the first infinite impulse response filter 45 with the corrected coefficient then converts the error audio source signal received into a low frequency audio source correction signal for outputting to a feed-forward least mean square filter 411 of the feed-forward noise cancellation filter module 41. When the noise shaper 44 detects a regular noise, it adjusts a coefficient of the second infinite impulse response filter 46 in order to set the second infinite impulse response filter 46 as a band-pass filter, and the second infinite impulse response filter 46 with the corrected coefficient then converts the error audio source signal into a designated bandwidth audio source correction signal for outputting to a feedback least mean square filter 422 of the feedback noise cancellation filter module 42.

Figure 7:
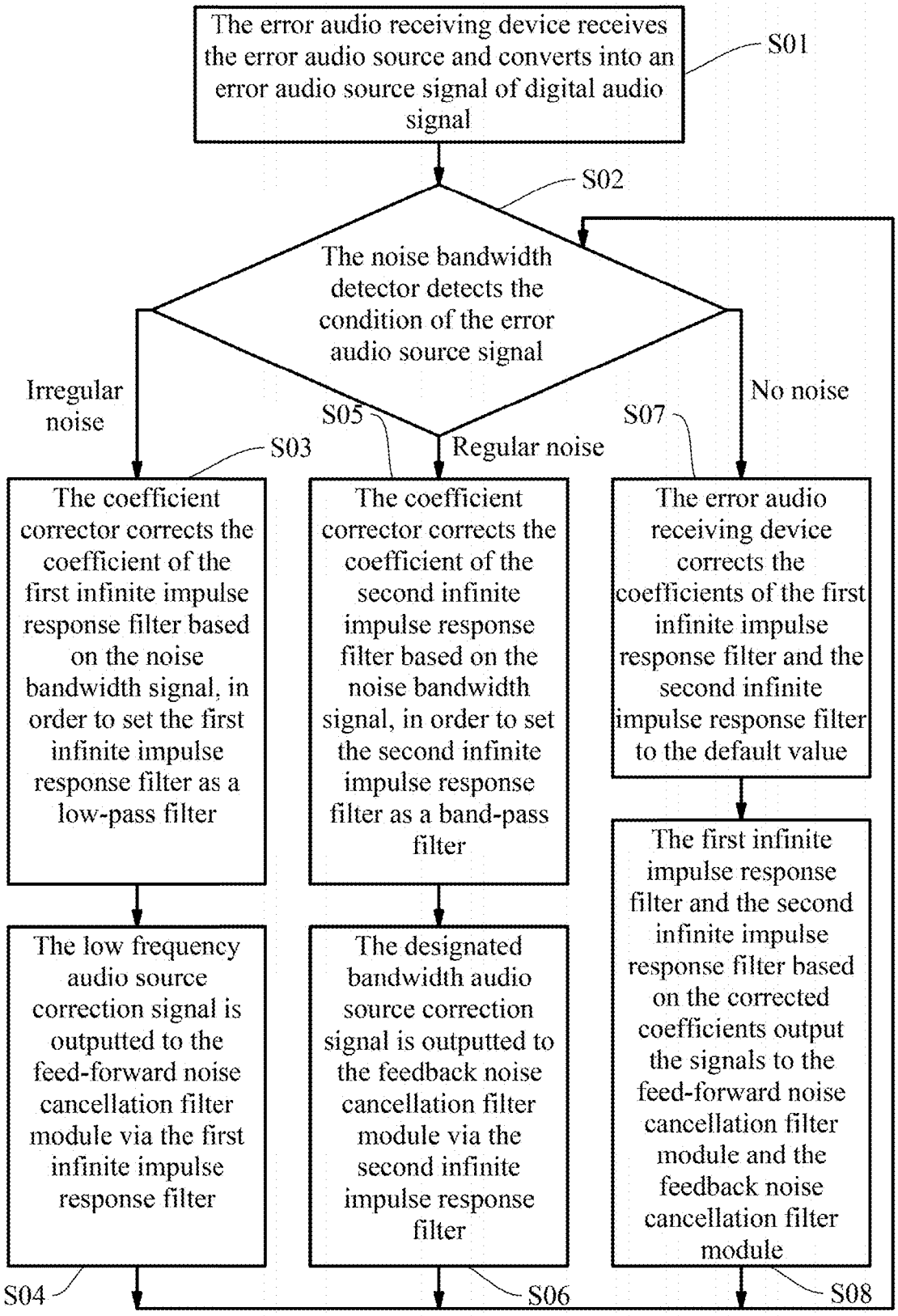
FIG. 7 shows a working flow chart of the improved noise separation hybrid active noise cancellation system of the present invention.

The above provides detailed description on the hardware architecture of the present invention based on an exemplary embodiment. For the working method of the present invention, please refer to the following further description. In addition to the previously mentioned FIG. 1 to FIG. 6, Please further refer to FIG. 7, showing a working flow chart of the improved noise separation hybrid active noise cancellation system of the present invention:

First, after the error audio receiving device 20 receives the error audio source (environmental noise after noise cancellation), the error audio source is converted into an error audio source signal of digital audio signal (Step S01). In addition, except for the first set of data of the error audio source, the rest is the sound received after the previous noise cancellation. Furthermore, the error audio source also includes the impact of the physical noise cancellation (such as ear muffs) such that it may be different from the original environmental noise.

Next, the noise bandwidth detector 441 detects the noise bandwidth distribution of the error audio source signal, in order to track the state of the error audio source signal (Step S02). When the noise bandwidth detector 441 detects an irregular noise, it then executes Step S03. When the noise bandwidth detector 441 detects a regular noise, it then executes Step S05. When the noise bandwidth detector 441 does not detect any noise, it then executes Step S07.

When an irregular noise is received, the noise bandwidth detector 441 outputs a noise bandwidth signal having a bandwidth identical to the center frequency of the error audio source signal to the coefficient corrector 442. The coefficient corrector 442 then corrects the coefficient of the biquadratic filters of levels 1 to N of the first infinite impulse response filter 45 based on the noise bandwidth signal, in order to set the first infinite impulse response filter 45 as a low-pass filter (Step S03).

In addition, the noise bandwidth detector 441 obtains the center frequency via the error signal based on the following equation:

$$f_k=\sum_{n=0}^{M-1}x[n]\times e^{-i2\pi k\frac{n}{M}};$$

$$k=0,\ldots,M-1;$$

wherein x[n] refers to an error audio source signal inputted by the error audio receiving device at level n, $f_k$ refers to the center frequency outputted by the noise bandwidth detector, $f_k$ contains a total of M number of outputs, and M refers to a default output quantity.

The coefficient corrector 442 corrects coefficients of the biquadratic filters of each level in the first infinite impulse response filter 45 based on the following equation:

$$b_0=\frac{1-\cos(w_0)}{2\times(1+\alpha)};$$

$$b_1=\frac{1-\cos(w_0)}{(1+\alpha)};$$

$$b_2=\frac{1-\cos(w_0)}{2\times(1+\alpha)};$$

$$a_1=\frac{-2\times\cos(w_0)}{(1+\alpha)};$$

$$a_2=\frac{(1-\alpha)}{(1+\alpha)};$$

wherein $w_0$ refers to a central angular frequency value, a refers to a natural frequency parameter, $b_0$, $b_1$, $b_2$, $a_1$, and $a_2$ refer to coefficients of the biquadratic filters.

The central angular frequency value and the natural frequency parameter are obtained from the noise bandwidth detector 441 based on the following equation:

$$w_0=2\times\pi\times\frac{f_k}{F_s};$$

$$\alpha=\frac{\sin w_0}{2\times Q};$$

wherein $f_k$ refers to a center frequency obtained by the noise bandwidth detector, $F_s$ refers to a frequency inputted by the reference audio receiving device, Q refers to a default quality parameter, $w_0$ refers to the central angular frequency value, and a refers to the natural frequency parameter.

In one embodiment, for Step S03, in addition to the correction of the coefficients of the biquadratic filters in the first infinite impulse response filter 45 based on the aforementioned method, the coefficients of the biquadratic filters of the second infinite impulse response filter 46 are also reset to the default value ($d_0$=1; other parameters are 0).

Next, according to Step S03, after the coefficients of the biquadratic filters of each level in the first infinite impulse response filter 45 are corrected, high frequency noise of the error audio source signal sampled is then eliminated based on the first infinite impulse response filter 45 with the corrected coefficient, following which the low frequency audio source correction signal is outputted to the feed-forward noise cancellation filter module 41 via the biquadratic filters of levels 1 to N of the first infinite impulse response filter 45 (Step S04). After execution is complete, it then returns back to Step S02, and the noise bandwidth detector 441 then continues to track the state of the error audio source signal.

According to Step S02, when a regular noise is received, the noise bandwidth detector 441 outputs a noise bandwidth signal having a bandwidth identical to the center frequency of the error audio source signal to the coefficient corrector 442. The coefficient corrector 442 then corrects the coefficients of the biquadratic filters of levels 1 to N of the second infinite impulse response filter 46 based on the noise bandwidth signal, in order to set the second infinite impulse response filter 46 as a band-pass filter (Step S05).

The noise bandwidth detector 441 obtains the center frequency via the error signal based on the following equation:

$$f_k = \sum_{n=0}^{M-1} x[n] \times e^{-i2\pi k \frac{n}{M}};$$

$$k = 0, \ldots, M-1;$$

wherein x[n] refers to an error audio source signal inputted by the error audio receiving device at level n, $f_k$ refers to the center frequency outputted by the noise bandwidth detector, $f_k$ contains a total of M number of outputs, and M refers to a default output quantity.

The coefficient corrector 442 corrects one or a plurality of coefficients of the biquadratic filters of the second infinite impulse response filter 46 based on the following equation:

$$d_0 = \frac{1+\cos(w_0)}{2\times(1+\alpha)};$$

$$d_1 = \frac{1+\cos(w_0)}{(1+\alpha)};$$

$$d_2 = \frac{1+\cos(w_0)}{2\times(1+\alpha)};$$

$$c_1 = \frac{-2\times\cos(w_0)}{(1+\alpha)};$$

$$c_2 = \frac{(1-\alpha)}{(1+\alpha)};$$

The coefficient corrector 442 corrects other one or a plurality of coefficients of the biquadratic filters of the second infinite impulse response filter 46 based on the following equation:

$$d_0 = \frac{1-\cos(w_0)}{2\times(1+\alpha)};$$

$$d_1 = \frac{1-\cos(w_0)}{(1+\alpha)};$$

$$d_2 = \frac{1-\cos(w_0)}{2\times(1+\alpha)};$$

$$c_1 = \frac{-2\times\cos(w_0)}{(1+\alpha)};$$

$$c_2 = \frac{(1-\alpha)}{(1+\alpha)};$$

wherein $w_0$ refers to a central angular frequency value, a refers to a natural frequency parameter, $d_0$, $d_1$, $d_2$, $c_1$, and $c_2$ refer to coefficients of the biquadratic filters.

The aforementioned biquadratic filter selected can be set up according to the predefined setting method, or can be actively set up based on the characteristics of the error audio source signal received (such as based on the frequency band or bandwidth, etc. of the error audio source signal). With the aforementioned configuration, the biquadratic filters of some levels of the second infinite impulse response filter 46 will form the low-pass filter (LPF), and the biquadratic filters of some levels of the second infinite impulse response filter 46 will form the high-pass filter (HPF). After connecting the low-pass filter (LPF) and the high-pass filter (HPF) in series, a band-pass filter can be constructed.

The central angular frequency value and the natural frequency parameter are obtained from the noise bandwidth detector 441 based on the following equation:

$$w_0 = 2\times\pi\times\frac{f_k}{F_s};$$

$$\alpha = \sin\left(\frac{w_0}{2\times Q}\right);$$

wherein $f_k$ refers to a center frequency obtained by the noise bandwidth detector, $F_s$ refers to a frequency inputted by the reference audio receiving device, Q refers to a default quality parameter, $w_0$ refers to the central angular frequency value, and a refers to the natural frequency parameter.

In one embodiment, for Step S05, in addition to the correction of the coefficients of the biquadratic filters in the second infinite impulse response filter 46 based on the aforementioned method, the coefficients of the biquadratic filters of the first infinite impulse response filter 45 are also reset to the default value ($b_0$=1; other parameters are 0).

Next, according to Step S05, after the coefficients of the biquadratic filters of each level in the second infinite impulse response filter 46 are corrected, the noise of the error audio source signal sampled is then eliminated based on the second infinite impulse response filter 46 with the corrected coefficient, following which the designated bandwidth audio source correction signal is outputted to the feedback noise cancellation filter module 42 via the biquadratic filters of levels 1 to N of the second infinite impulse response filter 46 (Step S06). After execution is complete, it then returns back to Step S02, and the noise bandwidth detector 441 then continues to track the state of the error audio source signal.

According to Step S02, when no noise is received, or the noise does not exceed the threshold value, the noise bandwidth detector 441 outputs a reset signal to the coefficient corrector 442. The coefficient corrector 442 then corrects the coefficients of the biquadratic filters of levels 1 to N of the first infinite impulse response filter 45 and the second infinite impulse response filter 46 based on the noise bandwidth signal, in order to correct the coefficients of the biquadratic filters of levels 1 to N to default value ($b_0$=1; $d_0$=1; other parameters are 0) (Step S07).

According to Step S07, after the coefficients of the biquadratic filters of each level of the first infinite impulse response filter 45 and the second infinite impulse response filter 46 are corrected, signals are outputted according to the corrected coefficients to the feed-forward noise cancellation filter module 41 and the feedback noise cancellation filter module 42 (Step S08). After execution is complete, it then returns back to Step S03, and the noise bandwidth detector 441 then continues to track the state of the error audio source signal.

In view of the above, the present invention is able to prevent the impact of an irregular noise on the convergence of the feed-forward noise reduction filter module upon receipt of the irregular noise and is also able to prevent the impact of a regular noise on the convergence of the feedback noise reduction filter module upon the receipt of the regular noise, thereby effectively increasing the noise cancellation effect of the hybrid active noise cancellation system of the present invention.

The above is the detailed description of the present invention. However, the above is merely the preferred embodiment of the present invention and cannot be the limitation to the implement scope of the invention, which means the variation and modification according to the present invention may still fall into the scope of the present invention.

What is claimed is:

1. An improved noise separation hybrid active noise cancellation system, comprising:

a reference audio receiving device, receiving a reference audio source and outputting a reference audio source signal based on the reference audio source;

an error audio receiving device, receiving an error audio source and outputting an error audio source signal based on the error audio source;

an audio output device, outputting an audio signal; and an audio processing device, connected to the reference audio receiving device, the error audio receiving device and the audio output device; the audio processing device comprising a feed-forward noise cancellation filter module, a feedback noise cancellation filter module, a mixer, a noise shaper, a first infinite impulse response filter and a second infinite impulse response filter; the feed-forward noise cancellation filter module used for performing feed-forward noise cancellation on the reference audio signal received from the reference audio receiving device in order to obtain a feed-forward noise cancellation signal; the feedback noise cancellation filter module used for performing feedback noise cancellation on the error audio source signal received from the error audio receiving device in order to obtain a feedback noise cancellation signal; and transmitting the feed-forward noise cancellation signal and the feedback noise cancellation signal to the mixer to perform wave mixing, and outputting a noise cancellation signal after mixing to the audio output device; and wherein the noise shaper detects a noise bandwidth distribution of the error audio source signal, such that when the noise shaper detects an irregular noise, a coefficient of the first infinite impulse response filter is adjusted to set the first infinite impulse response filter as a low-pass filter, and the first infinite impulse response filter with the corrected coefficient converts the error audio source signal into a low frequency audio source correction signal for outputting to a feed-forward least mean square filter of the feed-forward noise cancellation filter module; when the noise shaper detects a regular noise, a coefficient of the second infinite impulse response filter is adjusted to set the second infinite impulse response filter as a band-pass filter, and the second infinite impulse response filter with the corrected coefficient converts the error audio source signal into a designated bandwidth audio source correction signal for outputting to a feedback least mean square filter of the feedback noise cancellation filter module.

2. The improved noise separation hybrid active noise cancellation system according to claim 1, wherein the feed-forward noise cancellation filter module comprises the feed-forward least mean square filter and a feed-forward adaptive filter; the feed-forward least mean square filter updates a weight coefficient of the feed-forward adaptive filter based on the reference audio source signal and the low frequency audio source correction signal; the feed-forward adaptive filter performs noise cancellation on the reference audio source signal based on the updated weight coefficient in order to output the feed-forward noise cancellation signal.

3. The improved noise separation hybrid active noise cancellation system according to claim 1, wherein the feedback noise cancellation filter module comprises a feedback mixer, the feedback least mean square filter and a feedback adaptive filter; the feedback mixer mixes the noise cancellation signal and the error audio source signal for outputting a mixed signal; the feedback least mean square filter updates a weight coefficient of the feedback adaptive filter based on the mixed signal and the designated bandwidth audio source correction signal; the feedback adaptive filter performs noise cancellation on the mixed signal based on the updated weight coefficient and outputs the feedback noise cancellation signal.

4. The improved noise separation hybrid active noise cancellation system according to claim 1, wherein the audio output device comprises a loudspeaker, a power amplifier connected to a front end of the loudspeaker, a reconstruction filter connected to a front end of the power amplifier, and a digital-analogue converter connected to a front end of the reconstruction filter.

5. The improved noise separation hybrid active noise cancellation system according to claim 1, wherein the reference audio receiving device comprises a reference microphone, a preamplifier connected to a rear end of the reference microphone, an anti-aliasing filter connected to a rear end of the preamplifier, and an analogue-digital converter connected to a rear end of the anti-aliasing filter.

6. The improved noise separation hybrid active noise cancellation system according to claim 1, wherein the error audio receiving device comprises an error microphone, a preamplifier connected to a rear end of the error microphone, an anti-aliasing filter connected to a rear end of the preamplifier, and an analogue-digital converter connected to a rear end of the anti-aliasing filter.

7. The improved noise separation hybrid active noise cancellation system according to claim 1, wherein the first infinite impulse response filter comprises biquadratic filters of levels 1 to N.

8. The improved noise separation hybrid active noise cancellation system according to claim 7, wherein the biquadratic filters perform filtering on the error audio source signal based on the following equation:

$$y[n]=b_0\times x[n]+b_1\times x[n-1]+b_2\times x[n-2]-a_1\times y[n-1]-a_2\times y[n-2];$$

wherein x[n], x[n−1], x[n−2] refer to signals inputted to the biquadratic filter at level n, level n−1, and level n−2, y[n], y[n−1], y[n−2] refer to signals outputted by the biquadratic filter at level n, level n−1 and level n−2, $b_0$, $b_1$, $b_2$, $a_1$, $a_2$ refer to coefficients of the biquadratic filter.

9. The improved noise separation hybrid active noise cancellation system according to claim 8, wherein a coefficient corrector of the noise shaper corrects coefficients of the biquadratic filters of each level in the first infinite impulse response filter based on the following equation:

$$b_0 = \frac{1-\cos(w_0)}{2\times(1+\alpha)};$$

$$b_1 = \frac{1-\cos(w_0)}{(1+\alpha)};$$

$$b_2 = \frac{1-\cos(w_0)}{2\times(1+\alpha)};$$

$$a_1 = \frac{-2\times\cos(w_0)}{(1+\alpha)};$$

$$a_2 = \frac{(1-\alpha)}{(1+\alpha)};$$

wherein $w_0$ refers to a central angular frequency value, a refers to a natural frequency parameter, $b_0$, $b_1$, $b_2$, $a_1$, and $a_2$ refer to coefficients of the biquadratic filters.

10. The improved noise separation hybrid active noise cancellation system according to claim 9, wherein the central angular frequency value and the natural frequency parameter are obtained from the noise shaper based on the following equation:

$$w_0 = 2\times\pi\times\frac{f_k}{F_s};$$

$$\alpha = \frac{\sin w_0}{2\times Q};$$

wherein $f_k$ refers to a center frequency obtained by the noise shaper, $F_s$ refers to a frequency inputted by the reference audio receiving device, Q refers to a default quality parameter, $w_0$ refers to the central angular frequency value, and a refers to the natural frequency parameter.

11. The improved noise separation hybrid active noise cancellation system according to claim 10, wherein the center frequency is obtained from the noise shaper based on the following equation via the error signal:

$$f_k = \sum_{n=0}^{M-1} x[n]\times e^{-i2\pi k\frac{n}{M}};$$

$$k = 0, \ldots, M-1;$$

wherein x[n] refers to an error audio source signal inputted by the error audio receiving device at level n, $f_k$ refers to the center frequency outputted by the noise shaper, $f_k$ contains a total of M number of outputs, and M refers to a default output quantity.

12. The improved noise separation hybrid active noise cancellation system according to claim 1, wherein the second infinite impulse response filter comprises biquadratic filters of levels 1 to N.

13. The improved noise separation hybrid active noise cancellation system according to claim 12, wherein the biquadratic filters perform filtering on the error audio source signal based on the following equation:

$$z[n]=d_0\times x[n]+d_1\times x[n-1]+d_2\times x[n-2]-c_1\times z[n-1]-c_2\times z[n-2];$$

wherein x[n], x[n−1], x[n−2] refer to signals inputted to the biquadratic filters at level n, level n−1, and level n−2, z[n], z[n−1], z[n−2] refer to signals outputted by the biquadratic filters at level n, level n−1 and level n−2, $d_0$, $d_1$, $d_2$, $c_1$, $c_2$ refer to coefficients of the biquadratic filters.

14. The improved noise separation hybrid active noise cancellation system according to claim 13, wherein a coefficient corrector of the noise shaper corrects one or a plurality of coefficients of the biquadratic filters of the biquadratic filters of levels 1 to N based on the following equation:

$$d_0 = \frac{1+\cos(w_0)}{2\times(1+\alpha)};$$

$$d_1 = \frac{1+\cos(w_0)}{(1+\alpha)};$$

$$d_2 = \frac{1+\cos(w_0)}{2\times(1+\alpha)};$$

$$c_1 = \frac{-2\times\cos(w_0)}{(1+\alpha)};$$

$$c_2 = \frac{(1-\alpha)}{(1+\alpha)};$$

the coefficient corrector of the noise shaper corrects other one or a plurality of coefficients of the biquadratic filters of the biquadratic filters of levels 1 to N based on the following equation:

$$d_0 = \frac{1-\cos(w_0)}{2\times(1+\alpha)};$$

$$d_1 = \frac{1-\cos(w_0)}{(1+\alpha)};$$

$$d_2 = \frac{1-\cos(w_0)}{2\times(1+\alpha)};$$

$$c_1 = \frac{-2\times\cos(w_0)}{(1+\alpha)};$$

$$c_2 = \frac{(1-\alpha)}{(1+\alpha)};$$

wherein $w_0$ refers to a central angular frequency value, a refers to a natural frequency parameter, $d_0$, $d_1$, $d_2$, $c_1$, and $c_2$ refer to coefficients of the biquadratic filters.

15. The improved noise separation hybrid active noise cancellation system according to claim 14, wherein the central angular frequency value and the natural frequency parameter are obtained from the noise shaper based on the following equation:

$$w_0 = 2 \times \pi \times \frac{f_k}{F_s};$$

$$\alpha = \sin\left(\frac{w_0}{2 \times Q}\right);$$

wherein $f_k$ refers to a center frequency obtained by the noise shaper, $F_s$ refers to a frequency inputted by the reference audio receiving device, Q refers to a default quality parameter, $w_0$ refers to the central angular frequency value, and a refers to the natural frequency parameter.

16. The improved noise separation hybrid active noise cancellation system according to claim 15, wherein the center frequency is obtained from the noise shaper based on the following equation via the error signal:

$$f_k = \sum_{n=0}^{M-1} x[n] \times e^{-i2\pi k \frac{n}{M}};$$

$$k = 0, \ldots, M-1;$$

wherein x[n] refers to an error audio source signal inputted by the error audio receiving device at level n, $f_k$ refers to the center frequency outputted by the noise shaper, $f_k$ contains a total of M number of outputs, and M refers to a default output quantity.

* * * * *